US007446763B2

(12) United States Patent
Kim

(10) Patent No.: US 7,446,763 B2
(45) Date of Patent: Nov. 4, 2008

(54) LIQUID CRYSTAL DISPLAY

(75) Inventor: Myeong-Su Kim, Suwon (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 712 days.

(21) Appl. No.: 10/931,975

(22) Filed: Sep. 2, 2004

(65) Prior Publication Data

US 2005/0052396 A1 Mar. 10, 2005

(30) Foreign Application Priority Data

Sep. 5, 2003 (KR) ..... 10-2003-0062201

(51) Int. Cl.
*G09G 5/00* (2006.01)

(52) U.S. Cl. ..... 345/211; 345/87

(58) Field of Classification Search ..... 345/87–100, 345/211; 349/130

See application file for complete search history.

(56) References Cited

U.S. PATENT DOCUMENTS 5,300,945 A * 4/1994 Iemoto et al. ..... 345/92
5,686,932 A * 11/1997 Tomita ..... 345/94
6,542,211 B1 * 4/2003 Okada et al. ..... 349/130
7,019,728 B2 * 3/2006 Lee et al. ..... 345/98
7,202,864 B2 * 4/2007 Park ..... 345/211

* cited by examiner

*Primary Examiner*—Bipin Shalwala
*Assistant Examiner*—Kevin Nguyen
(74) *Attorney, Agent, or Firm*—MacPherson Kwok Chen & Heid LLP

(57) ABSTRACT

A liquid crystal display is provided, which includes: a liquid crystal panel including a plurality of gate lines, a plurality of data lines, and a plurality of pixels, each pixel including a liquid crystal and a switching element connected to one of the gate lines and one of the data lines; a gate driver applying a gate signal to the gate lines, the gate signal including a first voltage for turning on the switching elements and a second voltage for turning off the switching elements; a data driver applying data voltages to the data lines; a signal controller controlling the gate driver and the data driver; and a voltage supplier applying a control voltage substantially equal to one of the first and the second voltages of the gate signal to the pixels without passing through the switching elements for a control time.

25 Claims, 4 Drawing Sheets

LIQUID CRYSTAL DISPLAY

BACKGROUND OF THE INVENTION (a) Field of the Invention

The present invention relates to a liquid crystal display and, in particular, to an optically compensated Birefringent mode liquid crystal display.

(b) Description of Related Art

Liquid crystal displays (LCDs) include two panels having pixel electrodes and a common electrode and a liquid crystal (LC) layer with dielectric anisotropy, which is interposed between the two panels. The pixel electrodes are arranged in a matrix, connected to switching elements such as thin film transistors (TFTs), and supplied with data voltages through the switching elements. The common electrode covers the entire surface of one of the two panels and is supplied with a common voltage. The pixel electrode, the common electrode, and the LC layer form a LC capacitor in circuital view, which is a basic element of a pixel along with the switching element connected thereto.

Among the LCDs, a twisted nematic (TN) mode LCD is usually used, but an optically compensated Birefringent (OCB) mode LCD has been developed and used for improving a response time of LC molecules and a view angle.

The OCB mode LCD uses a bend arrangement of the LC molecules and drives the liquid crystal with a voltage equal to or higher than a threshold voltage, which can maintain the bend arrangement.

The OCB mode LCD performs a preliminary operation of applying a voltage equal to the threshold voltage for obtaining a bend arrangement. The bend arrangement is obtained by shortly driving the TFTs with gate signals and data signals in the same way as the normal operation before starting main display operation. However, it is difficult to apply the exact voltage equal to the threshold voltage and the transition to the bend arrangement is too slow. Otherwise, the bend arrangement is obtained by applying a voltage generated by using a separate voltage generator such as a DC-to-DC converter. However, the addition of the separate voltage generator complicates the configuration of the LCD and limits the degree of freedom of the product design.

SUMMARY OF THE INVENTION

A liquid crystal display is provided, which includes: a liquid crystal panel including a plurality of gate lines, a plurality of data lines, and a plurality of pixels, each pixel including a liquid crystal and a switching element connected to one of the gate lines and one of the data lines; a gate driver applying a gate signal to the gate lines, the gate signal including a first voltage for turning on the switching elements and a second voltage for turning off the switching elements; a data driver applying data voltages to the data lines; a signal controller controlling the gate driver and the data driver; and a voltage supplier applying a control voltage substantially equal to one of the first and the second voltages of the gate signal to the pixels without passing through the switching elements for a control time.

The liquid crystal display may be an optically compensated Birefringent mode liquid crystal display and the control voltage may make the liquid crystal in a bend arrangement.

The control voltage may be equal to the first voltage of the gate signal.

The control time may be determined based on a reset signal supplied from an external device to the voltage supplier.

The voltage supplier may include a first switching unit transmitting the first voltage based on the reset signal. The first switching unit may include a first transistor transmitting a third voltage based on the reset signal and a second transistor that is turned on by the third voltage to transmit the first voltage. The first switching unit may further include a voltage divider connected between the first voltage and the third voltage, dividing the voltage difference between the first voltage and the third voltage, and applying the divided voltage to the second transistor.

The voltage supplier may further include a second switching unit that is connected between the panel and the first switching unit, transmits the first voltage to the panel, and blocks a voltage from the panel to the first switching unit. The second switching unit may include a first set of diodes including one or more diodes connected to different positions of the panel.

The voltage supplier may further include a third switching unit transmitting at least a common voltage to the pixels depending on an output of the second switching unit. The third switching unit may include a second set of diodes including at least a diode. The second set of diodes may include a plurality of diodes supplied with respective common voltages and connected to different positions of the panel.

The voltage supplier may further include a plurality of resistors, each resistor connected between one of the first set of diodes and a fourth voltage.

Each pixel may further include a liquid crystal capacitor including liquid crystal and connected between the switching element and the voltage supplier and a storage capacitor connected between the switching element and a third voltage.

The third voltage may be equal to a ground voltage or the second voltage for the control time.

An optically compensated birefringent mode liquid crystal display is provided, which includes: a liquid crystal panel including a plurality of gate lines, a plurality of data lines, a plurality of switching elements connected to the gate lines and the data lines, a plurality of pixel electrodes connected to the switching elements, a common electrode disposed opposite the pixel electrodes, and a liquid crystal layer disposed between the pixel electrodes and the common electrode; a gate driver applying a gate signal to the gate lines, the gate signal including a gate-on voltage for turning on the switching elements and a gate-off voltage for turning off the switching elements; a data driver applying data voltages to the data lines; a signal controller controlling the gate driver and the data driver; and a voltage supplier applying the gate-on voltage to the common electrode for a control time such that the liquid crystal layer is in a bend arrangement.

The voltage supplier may include: a switching unit including a first transistor transmitting a first voltage in response to a reset signal supplied from an external device and a second transistor activated by the first voltage to transmit the first voltage; a first diode unit including a plurality of first diodes connected in forward direction from the second transistor to respective positions of the common electrode; and a second diode unit including a plurality of second diodes supplied with respective common voltages, each of the second diodes connected to one of the first diodes and to a position of the common electrode.

The panel may further include a storage electrode line overlapping the pixel electrodes and supplied with the gate-on voltage or a ground voltage.

BRIEF DESCRIPTION OF THE DRAWINGS

The present invention will become more apparent by describing embodiments thereof in detail with reference to the accompanying drawings in which.

DETAILED DESCRIPTION OF EMBODIMENTS

Figure 1:
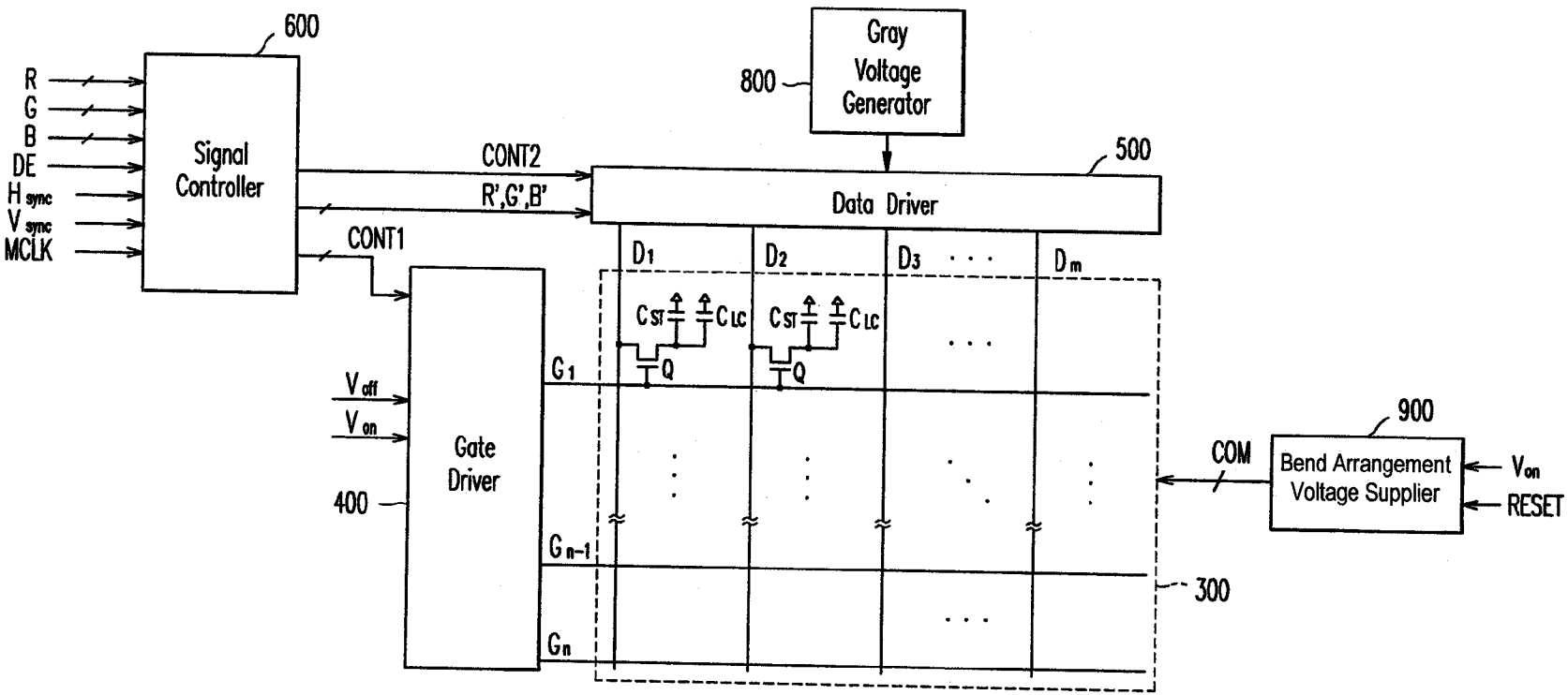
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, apparatus and methods of driving a liquid crystal display according to embodiments of the present invention will be described with reference to the accompanying drawings.

Figure 2:
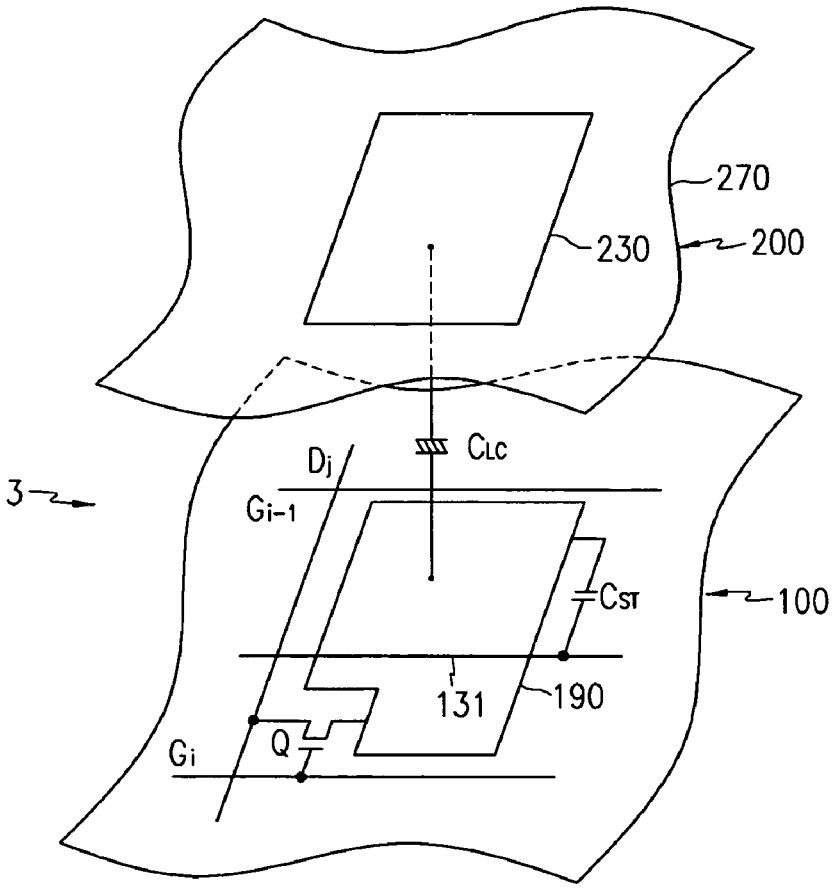
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a LC panel assembly 300, a gate driver 400 and a data driver 500 that are connected to the panel assembly 300, a gray voltage generator 800 connected to the data driver 500, a bend arrangement voltage supplier 900, and a signal controller 600 controlling the above elements. The LCD may be an OCB mode LCD.

Referring to FIG. 1, the panel assembly 300 includes a plurality of display signal lines $G_1$-$G_n$ and $D_1$-$D_m$ and a plurality of pixels connected thereto and arranged substantially in a matrix. In a structural view shown in FIG. 2, the panel assembly 300 includes lower and upper panels 100 and 200 and a LC layer interposed therebetween.

The display signal lines $G_1$-$G_n$ and $D_1$-$D_m$ are disposed on the lower panel 100 and include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and are substantially parallel to each other, while the data lines $D_1$-$D_m$ extend substantially in a column direction and are substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. If unnecessary, the storage capacitor $C_{ST}$ may be omitted.

The switching element Q including a TFT is provided on a lower panel 100 and has three terminals: a control terminal connected to one of the gate lines $G_1$-$G_n$; an input terminal connected to one of the data lines $D_1$-$D_m$; and an output terminal connected to both the LC capacitor $C_{LC}$ and the storage capacitor $C_{ST}$.

The LC capacitor $C_{LC}$ includes a pixel electrode 190 provided on the lower panel panel 100 and a common electrode 270 provided on an upper panel 200 as two terminals. The LC LC layer 3 disposed between the two electrodes 190 and 270 functions as a dielectric of the LC capacitor $C_{LC}$.

The pixel electrode 190 is connected to the switching element Q, and the common electrode 270 is supplied with a group of common voltages (COM) and covers an entire surface of the upper panel 200. In detail, the common voltages COM are supplied to a plurality of, for example, four places of the common electrode 270 and the magnitudes of the common voltages COM may be equal to or different from each other. The application of the common voltages COM to several places of the common electrode 270 can reduce the variation of the voltage of the common electrode 270 due to the resistance of the common electrode 270 itself.

LC molecules in the LC layer 3 are subjected to a bend arrangement, that is, the arrangement of the LC molecules are symmetrical with respect to an imaginary horizontal midplane disposed between the lower panel 100 and the upper panel 200.

Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a storage electrode line 131, which is provided on the lower panel 100, overlaps the pixel electrode 190 via an insulator, and is supplied with a predetermined voltage such as the common voltage COM. Alternatively, the storage capacitor $C_{ST}$ includes the pixel electrode 190 and an adjacent gate line called a previous gate line, which overlaps the pixel electrode 190 via an insulator.

For color displays, each pixel can represent its own color by providing one of a plurality of red, green and blue color filters 230 in an area corresponding to the pixel electrode 190. The color filter 230 shown in FIG. 2 is provided in the corresponding area of the upper panel 200. Alternatively, the color filters 230 are provided on or under the pixel electrode 190 on the lower panel 100.

One or more polarizers (not shown) are attached to at least one of the panels 100 and 200.

Referring to FIG. 1 again, the gray voltage generator 800 generates two sets of a plurality of gray voltages related to the transmittance of the pixels. The gray voltages in one set have a positive polarity with respect to the common voltage COM, while those in the other set have a negative polarity with respect to the common voltage COM.

The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$. The gate driver 400 may include a plurality of ICs (integrated circuits).

The data driver 500 is connected to the data lines $D_1$-$D_m$ of the panel assembly 300 and applies data voltages, which are selected from the gray voltages supplied from the gray voltage generator 800, to the data lines $D_1$-$D_m$. The data driver 500 may include a plurality of ICs, too.

The ICs of the drivers 400 and 500 may be mounted on the panel assembly 300 or on flexible printed circuit (FPC) films in a TCP (tape carrier package) type which are attached to the LC panel assembly 300. Alternately, the ICs may be integrated into the panel assembly 300 along with the display signal lines $G_1$-$G_n$ and $D_1$-$D_m$ and the TFT switching elements Q.

The signal controller 600 controls the gate driver 400 and the data driver 500 and it may be mounted on a printed circuit board (PCB).

The bend arrangement voltage supplier 900 supplies a voltage for the bend arrangement of the LC molecules. The bend arrangement voltage supplier 900 may be mounted on the PCB mounting the signal controller or directly mounted on the LC panel assembly 300.

Now, the operation of the LCD will be described in detail.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the image signals R, G and B suitable for the operation of the panel assembly 300 on the basis of the input control signals and the input image signals R, G and B, the signal controller 600 provides the gate control signals CONT1 for the gate driver 400, and the processed image signals R', G' and B' and the data control signals CONT2 for the data driver 500.

The gate control signals CONT1 include a scanning start signal STV for instructing to start scanning and at least a clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of start of a horizontal period, a load signal LOAD for instructing to apply the data voltages to the data lines $D_1$-$D_m$, a inversion control signal RVS for reversing the polarity of the data voltages (with respect to the common voltage COM), and a data clock signal HCLK.

The data driver 500 receives a packet of the image data R', G' and B' for a pixel row from the signal controller 600 and converts the image data R', G' and B' into analog data voltages selected from the gray voltages supplied from the gray voltage generator 800 in response to the data control signals CONT2 from the signal controller 600. Thereafter, the data driver 500 applies the data voltages to the data lines $D_1$-$D_m$.

Responsive to the gate control signals CONT1 from the signal controller 600, the gate driver 400 applies the gate-on voltage Von to the gate line $G_1$-$G_n$, thereby turning on the switching elements Q connected thereto. The data voltages applied to the data lines $D_1$-$D_m$ are supplied to the pixels through the activated switching elements Q.

The difference between the data voltage and the common voltage COM is represented as a voltage across the LC capacitor $C_{LC}$, i.e., a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into the light transmittance.

By repeating this procedure by a unit of the horizontal period (which is denoted by 1 H and equal to one period of the horizontal synchronization signal Hsync and the data enable signal DE), all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (for example, line inversion and dot inversion), or the polarity of the data voltages in one packet are reversed (for example, column inversion and dot inversion).

The OCB mode LCD requires the LC molecules to be arranged in a bend arrangement before normally displaying images. For this purpose, the bend arrangement voltage supplier 900 applies a predetermined voltage, for example, 10V or more, between the common electrode 270 and the pixel electrode 190 for a predetermined time. For example, the bend arrangement voltage supplier 900 applies the gate-on voltage Von having a magnitude of about 22 volts to the common electrode 270 of the panel assembly 300. At the same time, a signal line such as a storage electrode line 131 connected to a terminal of the storage capacitor $C_{ST}$, which has the other terminal connected to the pixel electrode 190, is supplied with a ground voltage. This makes the voltage across the LC capacitor $C_{LC}$ equal to about 10 volts. A technique for improving the transition speed into the bend arrangement of the LC molecules is described in a U.S. patent application Ser. No. 09/986,707 filed on Nov. 9, 2001, which is incorporated herein by reference.

Next, the operation of the bend arrangement voltage supplier according to an embodiment of the present invention will be described in detail with reference to FIGS. 3 and 4.

Figure 3:
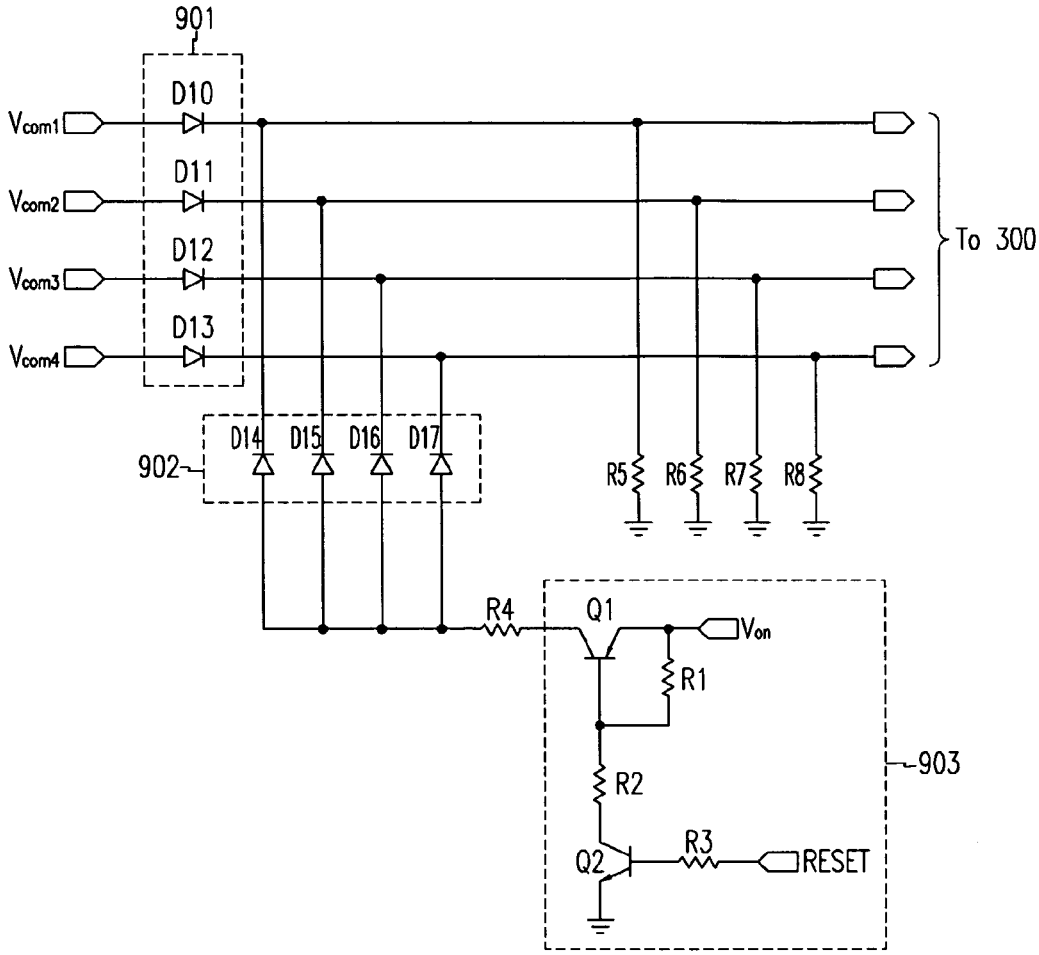
FIG. 3 is a circuit diagram of a bend arrangement voltage supplier according to an embodiment of the present invention.
Figure 4:
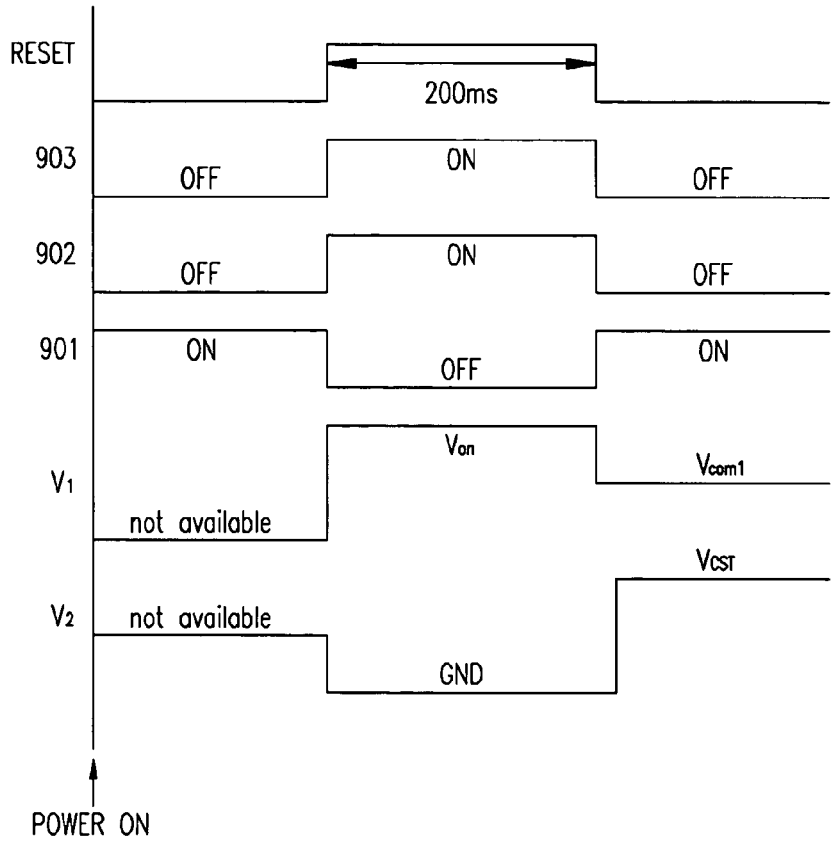
FIG. 4 is a timing diagram of the bend arrangement voltage supplier shown in FIG. 3.

FIG. 3 is a circuit diagram of a bend arrangement voltage supplier according to an embodiment of the present invention and FIG. 4 is a timing diagram of the bend arrangement voltage supplier shown in FIG. 3.

Referring to FIG. 3, a bend arrangement voltage supplier 900 according to this embodiment includes a first diode unit 901 connected to the LC panel assembly 300, a second diode unit 902 connected to the first diode unit 901, a resistor R4 connected to the second diode unit 902, a switching unit 903 connected to the resistor R4 and supplied with the gate-on voltage Von and a reset signal RESET, and a plurality of resistors R5-R8 connected between the first diode unit 901 and a ground.

The diode unit 901 includes a plurality of diodes D10-D13 having cathodes supplied with respective common voltages Vcom1-Vcom4 and anodes connected to the LC panel assembly 300.

The diode unit 902 includes a plurality of diodes D14-D17 having cathodes commonly connected to the resistor R4 and anodes connected to the anodes of the diodes D10-D13, respectively, to be connected to the LC panel assembly 300.

The switching unit 903 includes two transistors Q1 and Q2, each having an input terminal, a control terminal, and an output terminal, and a plurality of resistors R1-R3. The input terminal of the transistor Q1 is supplied with the gate-on voltage Von, the output terminal thereof is connected to the resistor R4. The resistor R1 is connected between the input terminal and the control terminal of the transistor Q1. The resistor R2 is connected between the control terminal of the transistor Q1 and the input terminal of the transistor Q2 and the output terminal of the transistor Q1 is grounded. The resistor R3 is connected between the control terminal of the transistor Q2 and a reset signal RESET.

When a power from an external device is supplied to the LCD responsive to an activation of a switch by a user, a voltage generator (not shown) generates various voltages such as the gate-on voltage Von, the gate-off voltage Voff, supply voltages, and the ground voltage, etc. After a predetermined time, the reset signal RESET supplied to the bend arrangement voltage supplier 900 becomes a high level for a predetermined time, for example, about 200 ms. The reset signal RESET may be generated by the signal controller 600 in relation to the voltage generation operation according to a software program, or generated by a separate switching device.

Responsive to the reset signal RESET applied through the resistor R3, the transistor Q2 of the switching unit 903 turns on to connect the resistor R2 to the ground. Then, the control terminal of the transistor Q1 is connected to the ground through the resistor R2 and turns on to connect the resistor R4 to the gate-on voltage Von. Accordingly, the switching unit 903 is turned on to transmit the gate-on voltage Von while the reset signal RESET is in the high level, as shown in FIG. 4.

The gate-on voltage Von is applied to the second diode unit 902 through the resistor R4 and turns on the diodes D14-D17 to apply the gate-on voltage Von to a plurality of places of the panel assembly 300. Accordingly, the common voltages Vcom1-Vcom4 to be applied to the panel assembly 300 through the diodes D10-D13 are blocked as shown in FIG. 4. At the same time, the storage electrode line 131 is supplied with a ground voltage.

Since the magnitude of the gate-on voltage Von is equal to about +22V, a voltage difference between the common electrode 270 and the storage electrode line 131 is equal to about +22V while the reset signal RESET is in the high level. Therefore, the LC capacitor $C_{LC}$ is supplied with a voltage equal to or larger than the threshold voltage, thereby obtaining the bend arrangement of the LC molecules.

After the predetermined time elapses, the reset signal RESET becomes low and the transistors Q2 and Q1 of the switching unit 903 are turned-off in response thereto and block the gate-on voltage Von to be applied to the second diode unit 902.

Then, the common voltages Vcom1-Vcom4 from an external device are applied to the respective places of the LC panel 300 through the first diode unit 901. Since the diodes D14-D17 of the second diode unit 902 are connected in the reverse direction from the diodes D10-D13, respectively, the common voltages Vcom1-Vcom4 are not transmitted to the switching unit 903.

The resistors R5-R8 provide a passage for discharging the gate-on voltage Von on the transmission lines when the state of the reset signal RESET is changed from the high state to the low state such that the common voltages Vcom1-Vcom4 are normally applied to the LC panel assembly 300.

FIG. 4 shows that a voltage V1 applied to a place of the common electrode 270 is equal to the gate-on voltage Von during the high level duration of the reset signal RESET, while the voltage V1 becomes equal to the common voltage Vcom1 after the reset signal RESET is changed from the high level into the low level. In addition, a voltage V2 applied to the storage electrode line 131 is equal to the ground voltage GND during the high level duration of the reset signal RESET, while the voltage V2 becomes equal to a voltage Vcst that may be one of the common voltages Vcom1-Vcom4 after the reset signal RESET is changed from the high level into the low level.

The storage electrode line 131 may be supplied with the gate-off voltage Voff instead of the ground voltage GND. Since the magnitude of the gate-off voltage Voff is equal to about −6V, the voltage across the LC capacitor $C_{LC}$ becomes high and the transition speed into the bend arrangement of the LC molecules can be increased.

As described above, since the bend arrangement of the LC molecules is realized by using the gate-on voltage Von without providing a separate voltage generator, the configuration and the size of the LCD are simplified. Furthermore, the application of the gate-off voltage Voff to the storage electrode line increases the voltage difference between the common electrode and the storage electrode line to improve the transition speed into the bend arrangement of the LC molecules. In addition, the application of the common voltages COM to several places of the common electrode 270 can reduce the variation of the voltage of the common electrode 270 due to the resistance of the common electrode 270 itself.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a liquid crystal panel including a plurality of gate lines, a plurality of data lines, and a plurality of pixels, each pixel including a liquid crystal and a switching element connected to one of the gate lines and one of the data lines, and two electrodes selectively forming an electric field in the liquid crystal;

a gate driver applying a gate signal to the gate lines, the gate signal including a first voltage for turning on the switching elements and a second voltage for turning off the switching elements;

a data driver applying data voltages to the data lines;

a signal controller controlling the gate driver and the data driver; and a voltage supplier applying a control voltage substantially equal to one of the first and the second voltages of the gate signal to one of the two electrodes without passing through the switching elements for a control time, the control time being determined based on a reset signal supplied from an external device to the voltage supplier, and wherein the voltage supplier comprises a first switching unit transmitting the first voltage based on the reset signal, and further wherein the first switching unit comprises:

a first transistor transmitting a third voltage based on the reset signal; and a second transistor that is turned on by the third voltage to transmit the first voltage.

2. The liquid crystal display of claim 1, wherein the liquid crystal display is an optically compensated birefringent mode liquid crystal display and the control voltage makes the liquid crystal in an initial bend arrangement.

3. The liquid crystal display of claim 1, wherein the control voltage is equal to the first voltage of the gate signal.

4. The liquid crystal display of claim 1, wherein the first switching unit further comprises a voltage divider connected between the first voltage and the third voltage, dividing the voltage difference between the first voltage and the third voltage, and applying the divided voltage to the second transistor.

5. The liquid crystal display of claim 1, wherein the voltage supplier further comprises a second switching unit that is connected between the panel and the first switching unit, transmits the first voltage to the panel, and blocks a voltage from the panel to the first switching unit.

6. The liquid crystal display of claim 5, wherein the second switching unit comprises a first set of diodes including at least a diode.

7. The liquid crystal display of claim 6, wherein the first set of diodes comprises a plurality of diodes connected to different positions of the panel.

8. The liquid crystal display of claim 5, wherein the voltage supplier further comprises a third switching unit transmitting at least a common voltage to the pixels depending on an output of the second switching unit.

9. The liquid crystal display of claim 8, wherein the third switching unit comprises a second set of diodes including at least a diode.

10. The liquid crystal display of claim 9, wherein the second set of diodes comprises a plurality of diodes supplied with respective common voltages and connected to different positions of the panel.

11. The liquid crystal display of claim 1, wherein the voltage supplier further comprises:

a first diode unit including a plurality of first diodes connected in forward direction from the second transistor to respective positions of the panel; and a second diode unit including a plurality of second diodes supplied with respective common voltages, each of the second diodes connected to one of the first diodes and to a position of the panel.

12. The liquid crystal display of claim 11, wherein the voltage supplier further comprises a plurality of resistors, each resistor connected between one of the first diodes and a fourth voltage.

13. An optically compensated birefringent mode liquid crystal display comprising:

a liquid crystal panel including a plurality of gate lines, a plurality of data lines, a plurality of switching elements connected to the gate lines and the data lines, a plurality of pixel electrodes connected to the switching elements, a common electrode disposed opposite the pixel electrodes, and a liquid crystal layer disposed between the pixel electrodes and the common electrode;

a gate driver applying a gate signal to the gate lines, the gate signal including a gate-on voltage for turning on the switching elements and a gate-off voltage for turning off the switching elements;

a data driver applying data voltages to the data lines;

a signal controller controlling the gate driver and the data driver; and a voltage supplier applying the gate-on voltage to the common electrode for a control time such that the liquid crystal layer is in an initial bend arrangement, wherein the voltage supplier comprises:

a switching unit including a first transistor transmitting a first voltage in response to a reset signal supplied from an external device and a second transistor activated by the first voltage to transmit the first voltage;

a first diode unit including a plurality of first diodes connected in forward direction from the second transistor to respective positions of the common electrode; and a second diode unit including a plurality of second diodes supplied with respective common voltages, each of the second diodes connected to one of the first diodes and to a position of the common electrode.

14. The liquid crystal display of claim 13, wherein the panel further comprises a storage electrode line overlapping the pixel electrodes and supplied with the gate-on voltage or a ground voltage.

15. The liquid crystal display of claim 13, wherein each pixel further comprises a storage capacitor comprising a storage electrode, the pixel electrode, and an insulator layer disposed between the storage electrode and the pixel electrode, wherein the voltage supplier supplies a third voltage to the storage electrode.

16. The liquid crystal display of claim 15, wherein the third voltage is equal to a ground voltage or the second voltage for the control time.

17. A liquid crystal display comprising:

a liquid crystal panel including a plurality of gate lines, a plurality of data lines, and a plurality of pixels, each pixel including a liquid crystal and a switching element connected to one of the gate lines and one of the data lines, and two electrodes selectively forming an electric field in the liquid crystal;

a gate driver applying a gate signal to the gate lines, the gate signal including a first voltage for turning on the switching elements and a second voltage for turning off the switching elements;

a data driver applying data voltages to the data lines;

a signal controller controlling the gate driver and the data driver; and a voltage supplier applying a control voltage substantially equal to one of the first and the second voltages of the gate signal to one of the two electrodes without passing through the switching elements for a control time, the control time being determined based on a reset signal supplied from an external device to the voltage supplier, and wherein the voltage supplier comprises:

a first switching unit transmitting the first voltage based on the reset signal; and a second switching unit that is connected between the panel and the first switching unit, transmits the first voltage to the panel, and blocks a voltage from the panel to the first switching unit.

18. The liquid crystal display of claim 17, wherein the second switching unit comprises a first set of diodes including at least a diode.

19. The liquid crystal display of claim 18, wherein the first set of diodes comprises a plurality of diodes connected to different positions of the panel.

20. The liquid crystal display of claim 17, wherein the voltage supplier further comprises a third switching unit transmitting at least a common voltage to the pixels depending on an output of the second switching unit.

21. The liquid crystal display of claim 20, wherein the third switching unit comprises a second set of diodes including at least a diode.

22. The liquid crystal display of claim 21, wherein the second set of diodes comprises a plurality of diodes supplied with respective common voltages and connected to different positions of the panel.

23. The liquid crystal display of claim 17, wherein the voltage supplier further comprises:

a first diode unit including a plurality of first diodes connected in forward direction from the second transistor to respective positions of the panel; and a second diode unit including a plurality of second diodes supplied with respective common voltages, each of the second diodes connected to one of the first diodes and to a position of the panel.

24. A liquid crystal display comprising:

a liquid crystal panel including a plurality of gate lines, a plurality of data lines, and a plurality of pixels, each pixel including a liquid crystal and a switching element connected to one of the gate lines and one of the data lines, and two electrodes selectively forming an electric field in the liquid crystal;

a gate driver applying a gate signal to the gate lines, the gate signal including a first voltage for turning on the switching elements and a second voltage for turning off the switching elements;

a data driver applying data voltages to the data lines;

a signal controller controlling the gate driver and the data driver; and a voltage supplier applying a control voltage substantially equal to one of the first and the second voltages of the gate signal to one of the two electrodes without passing through the switching elements for a control time, the control time being determined based on a reset signal supplied from an external device to the voltage supplier, and wherein the voltage supplier comprises:

a switching unit including a first transistor transmitting a third voltage in response to a reset signal supplied from an external device and a second transistor activated by the third voltage to transmit the first voltage;

a first diode unit including a plurality of first diodes connected in forward direction from the second transistor to respective positions of the panel; and a second diode unit including a plurality of second diodes supplied with respective common voltages, each of the second diodes connected to one of the first diodes and to a position of the panel.

25. The liquid crystal display of claim 24, wherein the voltage supplier further comprises a plurality of resistors, each resistor connected between one of the first diodes and a fourth voltage.

* * * * *